US006877454B2

(12) United States Patent
Bowen et al.

(10) Patent No.: US 6,877,454 B2
(45) Date of Patent: Apr. 12, 2005

(54) SYSTEMS AND METHODS FOR TRANSPORTING FLUIDS IN CONTAINERS

(75) Inventors: Ronald R. Bowen, Magnolia, TX (US); Richard B. Harley, The Woodlands, TX (US); John A. Vermersch, New Ulm, TX (US); W. Brett Wilson, Sugar Land, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 10/161,281

(22) Filed: Jun. 3, 2002

(65) Prior Publication Data

US 2002/0178988 A1 Dec. 5, 2002

Related U.S. Application Data

(60) Provisional application No. 60/296,036, filed on Jun. 5, 2001.

(51) Int. Cl.[7] ..... B63B 35/40

(52) U.S. Cl. ..... 114/259; 114/74 R; 114/260

(58) Field of Search ..... 114/258, 259, 114/260, 74 R, 74 A

(56) References Cited

U.S. PATENT DOCUMENTS

| | | | | |
|---|---|---|---|---|
| 2,406,084 A | | 8/1946 | Levin | 114/77 |
| 3,191,568 A | * | 6/1965 | Schroeder et al. | 114/74 R |
| 3,349,742 A | | 10/1967 | Bylo | 114/77 |
| 3,417,721 A | * | 12/1968 | Vienna | 114/260 |
| 3,556,036 A | * | 1/1971 | Wells | 114/260 |
| 3,774,565 A | | 11/1973 | Paxos | 114/43.5 |
| 3,823,681 A | | 7/1974 | Cushing et al. | 114/43.5 |
| 3,841,254 A | | 10/1974 | Dragonas et al. | 114/77 R |
| 3,934,530 A | | 1/1976 | Kossa et al. | 114/43.5 |
| RE30,040 E | | 7/1979 | Kirby et al. | 114/260 |
| 4,438,719 A | | 3/1984 | Finsterwalder | 114/74 A |
| 4,898,112 A | * | 2/1990 | McGlew et al. | 114/259 |
| 5,722,341 A | | 3/1998 | Tornqvist | 114/260 |
| 6,047,747 A | | 4/2000 | Bowen et al. | 141/231 |
| 6,085,528 A | | 7/2000 | Woodall et al. | 62/45.1 |
| 6,203,631 B1 | | 3/2001 | Bowen et al. | 148/336 |
| 6,460,721 B1 | | 10/2002 | Bowen et al. | 220/586 |

FOREIGN PATENT DOCUMENTS

| | | | | |
|---|---|---|---|---|
| DE | 23 37 673 A1 | | 7/1973 | |
| DE | 31 43 457 A1 | * | 5/1983 | 114/260 |
| GB | 2075432 | | 11/1981 | |
| GB | 2 123 354 | | 2/1984 | |
| JP | 54-9885 | * | 1/1979 | 114/74 R |
| RU | 1557001 | | 4/1990 | |
| WO | WO 93/04914 | | 3/1993 | |
| WO | WO 94/00333 | * | 1/1994 | 114/74 R |
| WO | WO 98/26978 | | 6/1998 | |
| WO | WO 02/34617 | | 5/2002 | |

OTHER PUBLICATIONS

Examination Report from the Intellectual Property Office of Papua New Guinea, Application No. PG/P/02/00001, May 9, 2003, 7 pages.

* cited by examiner

*Primary Examiner*—Sherman Basinger

(57) ABSTRACT

Improved systems and methods for transporting fluids in containers are provided. Such improved systems and methods include floatable container vessels having one or more fluid containers and self-propelled marine transportation vessels that are adapted to be ballasted downwardly to permit the floatable container vessels to be floated onto or off of the marine transportation vessels, and are adapted to be deballasted so as to raise the floatable container vessels out of the water for transportation to another location.

20 Claims, 2 Drawing Sheets

SYSTEMS AND METHODS FOR TRANSPORTING FLUIDS IN CONTAINERS

This application claims the benefit of U.S. Provisional Application No. 60/296,036, filed Jun. 5, 2001.

FIELD OF THE INVENTION

This invention relates to improved systems and methods for transporting fluids in containers. More specifically, the improvement relates to transporting fluids in container vessels that can be floated onto and off of self-propelled marine transportation vessels. Advantageously, fluids can be loaded out of and/or into an offloaded container vessel while the marine transportation vessel transports other container vessels.

BACKGROUND OF THE INVENTION

Various terms are defined in the following specification. For convenience, a Glossary of terms is provided herein, immediately preceding the claims.

In marine transportation vessels typically used for transporting fluids such as liquefied natural gas ("LNG"), i.e., natural gas that has been liquefied at substantially atmospheric pressure and a temperature of about −162° C. (−260° F.), the fluid containers are integral with the marine transportation vessel's hull. As used herein, the term "Baseline Container Ship" will be used to refer to a marine transportation vessel with fluid containers that are integral with the marine transportation vessel's hull. For transport of LNG and other cryogenic temperature fluids, the fluid containers are often incorporated into a series of insulated holds (known as cold boxes) that extend through the middle two-thirds of a Baseline Container Ship.

U.S. Pat. No. 6,085,528 (the "PLNG Patent"), having corresponding International Publication Number WO 98/59085 and entitled "System for Processing, Storing, and Transporting Liquefied Natural Gas", and U.S. Pat. No. 6,460,721 (the "Composite Container Application"), having corresponding International Publication Number WO 00/57102 and entitled "Improved Systems and Methods for Producing and Storing Pressurized Liquefied Natural Gas", both describe containers and transportation vessels for storage and marine transportation of pressurized liquefied natural gas (PLNG) at a pressure in the broad range of about 1035 kPa (150 psia) to about 7590 kPa (1100 psia) and at a temperature in the broad range of about −123° C. (−190° F.) to out −62° C. (−80° F.). Containers described in the PLNG Patent are constructed from ultra-high strength, low alloy steels containing less than 9 wt % nickel. Containers described in the Composite Container Application comprise (i) a load-bearing vessel made from a composite material and (ii) a substantially non-load-bearing liner in contact with the vessel, said liner providing a substantially impermeable barrier to the PLNG. The PLNG Patent and the Composite Container Application are hereby incorporated herein by reference.

Loading and offloading of PLNG into and from a Baseline Container Ship at import and export terminals, respectively, would likely be accomplished with natural gas. It is expected that loading and unloading of PLNG using such a process would be relatively slow and would require that the Baseline Container Ship be berthed at the terminal for a period of days, depending on the PLNG cargo capacity of the Baseline Container Ship.

Barge and lighter carrying ships were designed and built in the 1960's and 1970's for the shipment of cargo to developing ports. Examples of these types of ships include Lighter Aboard SHip (LASH) and SEABEE designs. Both of these types of ships are in the U.S. Merchant Marine reserve fleet. FIG. 1 shows a SEABEE ship 10. The barges 12 on a SEABEE ship 10 are small enough to be lifted using elevator(s) 14 located at the stern of SEABEE ship 10; a SEABEE ship 10 does not take on ballast to float on or float off the barges 12.

A number of companies (Offshore Heavy Transport, Heeremac, etc.) operate heavy-lift ships, primarily for use in the offshore and construction industries. These ships ballast down to float under large objects, then deballast to pick them up and carry them on large, flat decks. The self-propelled heavy-lift vessel then transports its cargo to its destination, where it takes on ballast again to offload or float off the cargo.

In spite of the aforementioned advances in technology, fluid transfer systems and methods that utilize the benefits of ships that ballast down to float cargo on and off, and deballast to pick up and carry cargo, do not currently exist. It would be advantageous to have such systems and methods.

Therefore, an object of this invention is to provide fluid transfer systems and methods that utilize the benefits of ships that ballast down to float cargo on and off, and deballast to pick up and carry cargo. Other objects of this invention will be made apparent by the following description of the invention.

SUMMARY OF THE INVENTION

Consistent with the above-stated objects of the present invention, systems and methods are provided for transporting fluids. In one embodiment, such systems include (a) at least one floatable container vessel including at least one container suitable for containing said fluid; and (b) a self-propelled, side load marine transportation vessel adapted (i) to be ballasted downwardly within said water to permit said at least one floatable container vessel to be floated onto or off of said self-propelled, side load marine transportation vessel, and (ii) to be deballasted so as to raise said at least one floatable container vessel out of said water for transportation to another location; and such methods include (a) loading said fluid into at least one container suitable for containing said fluid, said container being situated on a floatable container vessel; and (b) loading said floatable container vessel onto a self-propelled, side load marine transportation vessel for transportation to another location, said self-propelled, side load marine transportation vessel adapted (i) to be ballasted downwardly within said water to permit said at least one floatable container vessel to be floated onto or off of said self-propelled, side load marine transportation vessel, and (ii) to be deballasted so as to raise said at least one floatable container vessel out of said water for transportation to another location. In another embodiment, such systems include (a) at least one floatable container vessel including at least one container suitable for containing said fluid; and (b) a self-propelled, stern load marine transportation vessel having a deck with at least two wing walls, each said wing wall having a top portion, and said stern load marine transportation vessel being adapted (i) to be ballasted downwardly within said water, such that at least said top portion of said wing walls is above the surface of said water, to permit said at least one floatable container vessel to be floated onto or off of said self-propelled, stern load marine transportation vessel, and (ii) to be deballasted so as to raise said at least one floatable container vessel out of said water for transportation to another location; and such methods include (a) loading said fluid into at least one container suitable for containing said fluid, said container being situated on a floatable container vessel; and (b) loading said floatable container vessel onto a self-propelled, stern load marine transportation vessel for transportation to another location, said self-propelled, stern load marine transportation vessel having a deck with at least two wing walls, each said wing wall having a top portion, and said stern load marine transportation vessel being adapted (i) to be ballasted downwardly within said water, such that at least said top portion of said wing walls is above the surface of said water, to permit said at least one floatable container vessel to be floated onto or off of said self-propelled, stern load marine transportation vessel, and (ii) to be deballasted so as to raise said at least one floatable container vessel out of said water for transportation to another location.

DESCRIPTION OF THE DRAWINGS

The advantages of the present invention will be better understood by referring to the following detailed description and the attached drawings in which.

While the invention will be described in connection with its preferred embodiments, it will be understood that the invention is not limited thereto. On the contrary, the invention is intended to cover all alternatives, modifications, and equivalents which may be included within the spirit and scope of the present disclosure, as defined by the appended claims.

DETAILED DESCRIPTION OF THE INVENTION

A typical project for the transport of a fluid, such as LNG, using the systems and methods of this invention will utilize multiple self-propelled marine transportation vessels to transport floatable container vessels, either substantially empty or containing fluids, between export and import terminals. In a preferred embodiment, the marine transportation vessels themselves are not equipped with fluid containers; all fluid containers are incorporated into the floatable container vessels. In the case of LNG, floatable container vessels are filled with LNG via any LNG container loading process at an export terminal. When a marine transportation vessel is delivered to the export terminal, or arrives at the export terminal with substantially empty containers in its floatable container vessel(s), the substantially empty container vessels are unloaded, and then container vessels containing LNG are loaded onto the marine transportation vessel. The offloaded container vessels are connected to the export terminal to be loaded with LNG for the next incoming marine transportation vessel. If desired, substantially empty floatable container vessels may be loaded with LNG while onboard the marine transportation vessel.

The marine transportation vessel with loaded container vessels then transits to the import terminal, where it discharges its LNG-containing container vessels to the import terminal. Then LNG is offloaded from these container vessels via any standard LNG offloading process. The marine transportation vessel takes on substantially empty container vessels for the backhaul run to the export terminal. If desired, LNG may be unloaded from container vessels while onboard the marine transportation vessel.

Variations in the transport system may include multiple export and import terminal stops and/or multiple marine transportation vessels for transporting multiple container vessels, depending on production rates and delivery contracts.

Various marine transportation vessel and container vessel configurations are possible for the systems and methods of this invention. However, practical and economic realities will likely lead to standardized container vessel design and marine transportation vessel arrangement for a given fluid transport project. For larger container vessels, such as those typically used to transport LNG, the marine transportation vessels will typically need to take on ballast to float on and float off container vessels.

Figure 1:
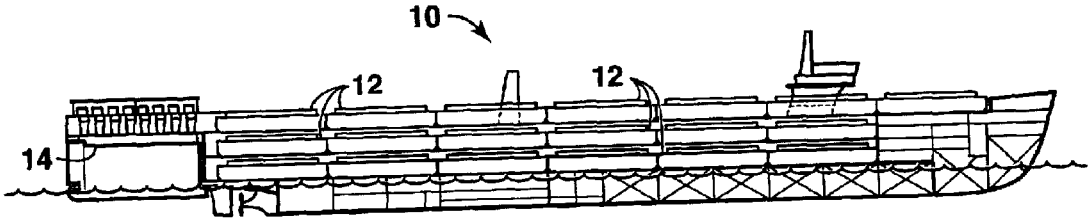
FIG. 1 (PRIOR ART)
FIG. 1 (PRIOR ART) illustrates a SEABEE ship.
Figure 2A:
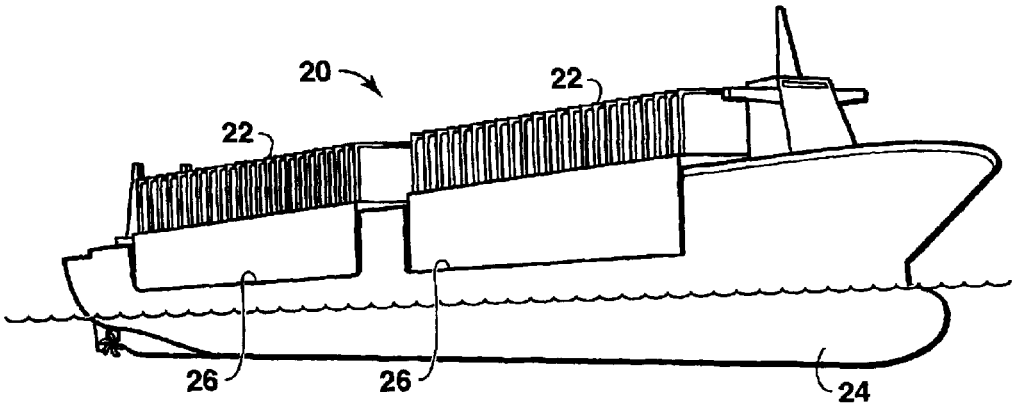
FIG. 2A illustrates a side load marine transportation vessel loaded with floatable container vessels, such that the floatable container vessels can be floated onto and off of the marine transportation vessel.
Figure 2B:
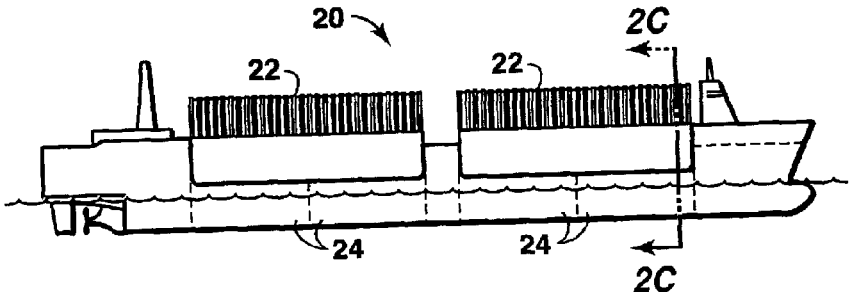
FIG. 2B illustrates a cutaway side view of the side load marine transportation vessel illustrated in FIG. 2A.
Figure 2C:
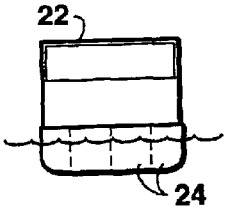
FIG. 2C illustrates a cutaway front view of the side load marine transportation vessel illustrated in FIG. 2B through a floatable container vessel as shown in FIG. 2B.

An example side load marine transportation vessel 20 according to this invention is illustrated in FIGS. 2A, 2B, and 2C. Marine transportation vessel 20 is shown transporting two floatable container vessels 22. When at an import or export terminal, side load marine transportation vessel 20 takes on sufficient seawater ballast in ballast tanks 24 to submerge deck 26 to a suitable position (depth) in the water in which marine transportation vessel 20 is floating so that floatable container vessels 22 may be floated off and replacement floatable container vessels 22 floated on.

Side load marine transportation vessel 20 is particularly advantageous because a terminal can be constructed that requires mooring of side load marine transportation vessel 20 only once to float off floatable container vessels 22 from one side of marine transportation vessel 20 and float on replacement floatable container vessels 22 from the opposite side of marine transportation vessel 20. Furthermore, side load marine transportation vessel 20 enables selected floatable container vessels 22 to be easily floated on and off, not requiring all such floatable container vessels 22 on side load marine transportation vessel 20 to be floated off at any import or export terminal. This is particularly advantageous when side load marine transportation vessel 20 visits multiple terminals in a single voyage.

Figure 3A:
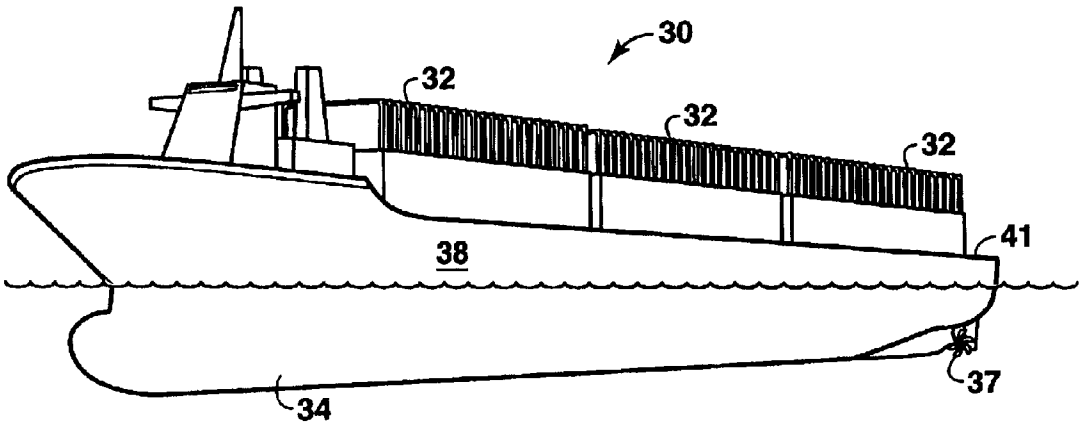
FIG. 3A illustrates a stern load marine transportation vessel loaded with floatable container vessels, such that the floatable container vessels can be floated onto and off of the marine transportation vessel over its stern.
Figure 3B:
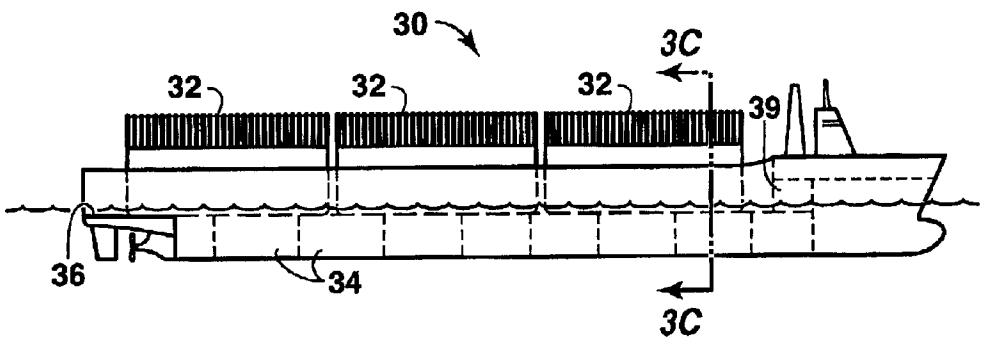
FIG. 3B illustrates a cutaway side view of the stern load marine transportation vessel illustrated in FIG. 3A.
Figure 3C:
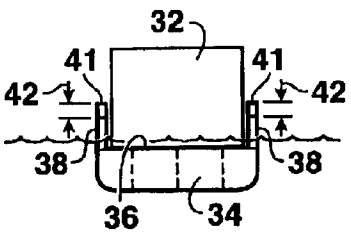
FIG. 3C illustrates a cutaway front view of the stern load marine transportation vessel illustrated in FIG. 3B through a floatable container vessel as shown in FIG. 3B.

An example stern load marine transportation vessel 30 according to this invention is illustrated in FIGS. 3A, 3B, and 3C. Stern load marine transportation vessel 30 is shown transporting three floatable container vessels 32. Deck 36 of marine transportation vessel 30 has at least two wing walls 38, each of said wing walls having a top portion 42. Preferably, for loading and unloading of container vessels 32, stern load marine transportation vessel 30 takes on only an adequate amount of seawater ballast in tanks 34 as is required to submerge deck 36 to such a depth in the water that the top portion 42 of each of wing walls 38 is above the surface of the water. Maintaining top portion 42 above the surface of the water provides water plane for stability of the marine transportation vessel 30 as it submerges in the water. To account for marine transportation vessel 30 motions when ballasted down and to provide margin against small waves in the terminal or port from overtopping wing walls 38, top portion 42 of wing walls 38 should be several meters (e.g., at least 3 to 4 meters) above the water. Also, when container vessels 32 are tall relative to the height of wing walls 38, maintaining top portion 42 at a height above the surface of the water in which stern load marine transportation vessel 30 is submerged for the continuous length of the portion of marine transportation vessel 30 used to carry floatable container vessels 32, enhances the structural efficiency of the hull of marine transportation vessel 30. Top portion 42 of wing wall 38 includes at least the top edge 41 of wing wall 38 and may include up to a significant portion of wing wall 38 immediately adjacent top edge 41 and extending downwardly toward deck 36. The specific height of top portion 42 that should be maintained above the surface of the water depends upon several factors as will be familiar to those skilled in the art, including without limitation: the size of marine transportation vessel 30; the size of floatable container vessels 32; the increase in draft to which marine transportation vessel 30 ballasts to allow floatable container vessels 32 to be floated on and off; the hydrostatic stability requirements for marine transportation vessel 30 when ballasted down; and the structural design of marine transportation vessel 30. Floatable container vessels 32 float in over the stern of marine transportation vessel 30 into the area within wing walls 38. In the embodiment of stern load marine transportation vessel 30 illustrated in FIGS. 3A, 3B, and 3C, engine room 39 is located forward and electric driven propeller/s 37 are installed. Diesel-electric is a probable propulsion choice. When at an export or import terminal, stern load marine transportation vessel 30 takes on sufficient seawater ballast in ballast tanks 34 to submerge deck 36 to a suitable position (depth) in the water in which marine transportation vessel 30 is floating so that floatable container vessels 32 may be floated off and replacement floatable container vessels 32 floated on over the stern of marine transportation vessel 30 With stern load marine transportation vessel 30, although deck 36 remains dry once deballasted, deck 36 preferably remains below the surface of the water during transport of floatable container vessels 32. The structural strength added to the hull of marine transportation vessel 30 by wing walls 38, facilitates carrying of floatable container vessels 32 fairly low in the hull of stern load marine transportation vessel 30, as compared to the position at which containers are commonly carried in fluid transport ships, thereby enhancing the hydrostatic stability of stern load marine transportation vessel 30.

Stern load marine transportation vessel 30 is particularly advantageous because a terminal can be constructed that requires mooring of stern load marine transportation vessel 30 only once to float off floatable container vessels 32 and to float on replacement floatable container vessels 32. In a preferred configuration, multiple floatable container vessels 32 are floated off as a connected unit and multiple replacement floatable container vessels 32 are floated on as a connected unit, enabling a short turn-around time for stern load marine transportation vessel 30 at the terminal. The terminal configuration preferably incorporates a means to linearly move floatable container vessels 32 out of stern load marine transportation vessel 30, relocate replacement floatable container vessels 32 to a position behind stern load marine transportation vessel 30, and then linearly float replacement floatable container vessels 32 onto marine transportation vessel 30 via the stern.

EXAMPLE

Nothing in this Example is intended as a limitation to the scope of this invention. As mentioned in the background section, the PLNG Patent describes containers and transportation vessels for storage and marine transportation of pressurized liquefied natural gas (PLNG) at a pressure in the broad range of about 1035 kPa (150 psia) to about 7590 kPa (1100 psia) and at a temperature in the broad range of about −123° C. (−190° F.) to about −62° C. (−80° F.). Containers described in the PLNG Patent are constructed from ultra-high strength, low alloy steels containing less than 9 wt % nickel. The Composite Container Application describes containers and transportation vessels for storage and marine transportation of pressurized liquefied natural gas (PLNG) at a pressure in the broad range of about 1035 kPa (150 psia) to about 7590 kPa (1100 psia) and at a temperature in the broad range of about −123° C. (−190° F.) to about −62° C. (−80° F.). Containers described in the Composite Container Application comprise (i) a load-bearing vessel made from a composite material and (ii) a substantially non-load-bearing liner in contact with the vessel, said liner providing a substantially impermeable barrier to the PLNG.

By making use of the systems and methods of this invention, PLNG may be transported in a system in which multiple self-propelled marine transportation vessels transport floatable container vessels, either substantially empty or containing PLNG, between export and import terminals. The marine transportation vessels themselves will not be equipped with PLNG containers; all PLNG containers will be incorporated into the floatable container vessels. Floatable container vessels at the export terminal will be filled with PLNG via any available PLNG container loading process. When the marine transportation vessel arrives with substantially empty floatable container vessels, it will offload the substantially empty container vessels, and then load PLNG-containing container vessels that had been taking on PLNG at the export terminal. The offloaded container vessels will be connected to the export terminal to be loaded with PLNG for the next incoming marine transportation vessel.

The marine transportation vessel with loaded floatable container vessels will then transit to an import terminal, where it discharges its PLNG-containing container vessels to the import terminal. These PLNG-containing container vessels will then offload the PLNG via any available PLNG offloading process. The marine transportation vessel will take on substantially empty container vessels for the back-haul run to the export terminal.

Variations in the transport system could include multiple export and import terminal stops, depending on the production rates and delivery contracts.

Various configurations are possible for marine transportation vessels and floatable container vessels for delivery of PLNG in accordance with this invention. However, practical and economic realities will likely lead to a standardized container vessel design and a standardized marine transportation vessel arrangement. Typically, due to the likely large size of PLNG container vessels, the marine transportation vessels will have to take on ballast to float off and float on the container vessels.

Advantageously, this invention has the potential for allowing at least one fewer PLNG marine transportation vessel for a project than would be required if the PLNG were transported by Baseline Ships.

While the foregoing invention has been described in terms of one or more preferred embodiments, it should be understood that other modifications may be made without departing from the scope of the invention, which is set forth in the following claims.

Glossary of Terms:

Baseline Container Ship: a marine transportation vessel with fluid containers that are integral with the marine transportation vessel's hull;

Composite Container Application: U.S. Pat. No. 6,460,721;

cryogenic temperature: any temperature of about −40° C. (−40° F.) and lower;

LNG: liquefied natural gas at substantially atmospheric pressure and about −162° C. (−260° F.);

PLNG: pressurized liquefied natural gas at a pressure in the broad range of about 1035 kPa (150 psia) to about 7590 kPa (1100 psia) and at a temperature in the broad range of about −123° C. (−190° F.) to about −62° C. (−80° F.);

PLNG Patent: U.S. Pat. No. 6,085,528.

We claim:

1. A system for transportation of a fluid having a temperature of about −40° C. (−40° F.) and lower ever water, said system comprising:

(a) at least on floatable container vessel including at least one container suitable for containing said fluid; and (b) a self-propelled, side load marine transportation vessel adapted (i) to be ballasted downwardly within said water to permit said at least one floatable container vessel to be floated onto or off of said self-propelled, side load marine transportation vessel, and (ii) to be deballasted so as to raise said at least one floatable container vessel out of said water for transportation to another location.

2. The system of claim 1, wherein said at least one floatable container vessal is self-propelled.

3. The system of claim 1, wherein said at least one floatable container vessel is self-propelled.

4. The system of claim 1, wherein said fluid is pressurized liquefied natural gas at a pressure in the broad range of about 1035 kPa (150 psia) to about 7590 kPa (100 psia) and at a temperature in the broad range of about −123° C.(−190° F.) to about −62° C. (−80F.).

5. A method for transportation of a fluid having a temperature of about −40° C.(−40° F.) and lower over water, said method comprising:

(a) loading said fluid into at least one container suitable for containing said fluid, said container being situated on a floatable container vessel; and (b) loading said floatable container vessel onto a self-propelled, side load marine transportation vessel for transportation to another location, said self-propelled, side load marine transportation vessel adapted (i) to be ballasted downwardly within said water to permit said at least one floatable container vessel to be floated onto or off of said self-propelled, side load marine transportation vessel, and (ii) to be deballasted so as to raise said at least one floatable container vessel out of said water for transportation to another location.

6. The method of claim 5, wherein said at least one floatable container vessel is self-propelled.

7. The method of claim 5, wherein said at least one floatable container vessel is non-self-propelled.

8. A method for transportation of a fluid over water, said method comprising:

(a) loading a floatable container vessel containing at least one container suitable for containing said fluid onto a self-propelled, side load marine transportation vessel for transportation to another location, said self-propelled, side load marine transportation vessel adapted (i) to be ballasted downwardly within said water to permit said at least one floatable container vessel to be floated onto or off of said self-propelled, side load marine transportation vessel, and (ii) to be deballasted so as to raise said at least one floatable container vessel out of said water for transportation to another location; and (b) loading said fluid into said at least one container.

9. The method of claim 8, wherein said at least one floatable container vessel is self-propelled.

10. The method of claim 8, wherein said at least one floatable container vessel is non-self-propelled.

11. A system for transportation of a fluid over water, said system comprising:

(a) at least one floatable container vessel including at least one container suitable for containing said fluid; and (b) a self-propelled, stern load marine transportation vessel having a deck with at least two wing walls, each said wing wall being continuous and having a top portion that consists essentially of a top edge and at least a portion of said wing wall immediately adjacent said top edge and extending downwardly toward said deck, said stern load marine transportation vessel having a forward located engine room and said stern load transportation vessel being adapted (i) to be ballasted downwardly within said water, such that at least said top portions of said wing walls are above the surface of said water, to permit said at least one floatable container vessel to be floated onto or off of said self-propelled, stern load marine transportation vessel, and (ii) to be deballasted so as to raise said at least one floatable container vessel out of said water for transportation to another location.

12. The system of claim 11, wherein said at least one floatable container vessel is self-propelled.

13. The system of claim 11, wherein said at least one floatable container vessel is non-self-propelled.

14. The system of claim 11, wherein said fluid is pressurized liquefied natural gas at a pressure in the broad range of about 1035 kPa (150 psia) to about 7590 kPa (1100 psia) and at a temperature in the broad range of about −123° C. (−190° F.) to about −62° C. (−80° C).

15. A method for transportation of a fluid over water, said method comprising;

(a) loading said fluid into at least one container suitable for containing said fluid, said container being situated on a floatable container vessel; and (b) loading said floatable container vessel onto a self-propelled, stern load marine transportation vessel for transportation to another location, said self-propelled, stern load marine transportation vessel having a deck with at least two wing walls, each said wing wall being continuous and having a top portion that consists essentially of a top edge and at least a portion of said wing wall immediately adjacent said top edge and extending downwardly toward said deck, said stern load marine transportation vessel having a forward located engine room and said stern load marine transportation vessel being adapted (i) to be ballasted downwardly within said water, such that at least said top portions of said wing walls are above the surface of said water, to permit said at least one floatable container vessel to be floated onto or off of said self-propelled, stern load marine transportation vessel, and (ii) to be deballasted so as to raise said at least one floatable container vessel out of said water for transportation to another location.

16. The method of claim 15, wherein said at least one floatable container vessel is self-propelled.

17. The method of claim 15, wherein said at least one floatable container vessel is non-self-propelled.

18. A method for transportation of a fluid over water, said method comprising:

(a) loading a floatable container vessel containing at least one container suitable for containing said fluid onto a self-propelled, stern load marine transportation vessel for transportation to another location, said self-propelled, stern load marine transportation vessel having a deck with at least two wing walls, each said wing wall being continuous and having a top portion, and said stern load marine transportation vessel being adapted to be ballasted downwardly within said water, such that at least said top portion of said wing walls is above the surface of said water, to permit said at least one floatable container vessel to be floated onto or off of said self-propelled, stern load marine transportation vessel, and (ii) to be deballasted so as to raise said at least one floatable container vessel out of said water for transportation to another location; and (b) loading said fluid into said at least one container.

19. The method of claim 18, wherein said at least one floatable container vessel is self-propelled.

20. The method of claim 18, wherein said at least one floatable container vessel is non-self-propelled.

* * * * *